US008853926B2

(12) United States Patent
Morin

(10) Patent No.: US 8,853,926 B2
(45) Date of Patent: Oct. 7, 2014

(54) SPARK PLUG WITH FIRING END HAVING DOWNWARD EXTENDING TINES

(76) Inventor: Robert Morin, Venice, CA (US)

( * ) Notice: Subject to any disclaimer, the term of this patent is extended or adjusted under 35 U.S.C. 154(b) by 0 days.

(21) Appl. No.: 13/305,376

(22) Filed: Nov. 28, 2011

(65) Prior Publication Data

US 2012/0133264 A1 May 31, 2012

Related U.S. Application Data

(63) Continuation-in-part of application No. 12/380,541, filed on Mar. 2, 2009, now abandoned, which is a continuation-in-part of application No. 11/239,564, filed on Sep. 28, 2005, now abandoned.

(60) Provisional application No. 60/613,221, filed on Sep. 28, 2004.

(51) Int. Cl.

| | |
|---|---|
| ***H01T 13/20*** | (2006.01) |
| ***H01T 13/39*** | (2006.01) |
| ***H01T 13/54*** | (2006.01) |
| ***H01T 13/46*** | (2006.01) |

(52) U.S. Cl.

CPC ..... *H01T 13/39* (2013.01); *H01T 13/54* (2013.01); *H01T 13/467* (2013.01)

USPC ..... 313/141; 313/143

(58) Field of Classification Search

CPC ..... H01T 13/06; H01T 13/20; H01T 13/26; H01T 13/34; H01T 13/46; H01T 13/467

USPC ..... 313/118–145

See application file for complete search history.

(56) References Cited

U.S. PATENT DOCUMENTS

| | | | | |
|---|---|---|---|---|
| 1,272,954 | A * | 7/1918 | Horning | 313/131 R |
| 2,900,546 | A * | 8/1959 | Russell | 313/125 |
| 3,958,144 | A * | 5/1976 | Franks | 313/138 |
| 4,639,576 | A | 1/1987 | Shoemaker et al. | |
| 4,730,582 | A | 3/1988 | Lindsay | |
| 4,954,743 | A | 9/1990 | Suzuki et al. | |

(Continued)

FOREIGN PATENT DOCUMENTS

WO WO 9321674 A1 * 10/1993

OTHER PUBLICATIONS

Gunther et al., Advanced Alumina Composites Reinforced with Titanium-Based Alloys (2001). J. Am. Ceram. Soc. 84 [7] pp. 1509-1513.*

*Primary Examiner* — Andrew Coughlin
(74) *Attorney, Agent, or Firm* — The Eclipse Group LLP

(57) ABSTRACT

A spark plug includes a body and a center electrode. The body includes a first end, a second end, an insulating portion and a shell portion. The shell portion includes an exterior threaded section, a nut section below the threaded section, an electrically conductive, axially elongated firing ring above the threaded section and terminating at an upper surface. The center electrode extends through the body and includes a terminal end and a firing end. The firing end extends beyond the second end of the body and includes a plurality of tines. Each tine includes a first section and a second section. The first section extends radially from the firing end. The second section extends axially toward the upper surface of the firing ring and terminates at a tip. The insulating portion electrically isolates the shell portion from the center electrode.

18 Claims, 6 Drawing Sheets

(56) References Cited

U.S. PATENT DOCUMENTS

| | | | | |
|---|---|---|---|---|
| 5,408,961 | A | 4/1995 | Smith | |
| 5,557,158 | A | 9/1996 | Kanao et al. | |
| 5,731,655 | A * | 3/1998 | Corrado | 313/138 |
| 6,414,419 | B1 * | 7/2002 | Kim | 313/141 |
| 6,628,049 | B2 | 9/2003 | Rosenthal et al. | |
| 6,750,597 | B1 * | 6/2004 | Sakura | 313/141 |
| 2002/0145371 | A1 | 10/2002 | Rosenthal et al. | |
| 2005/0016485 | A1 * | 1/2005 | Miwa et al. | 123/169 EL |
| 2009/0167135 | A1 * | 7/2009 | Morin | 313/141 |

* cited by examiner

100
B 132
128
126
104
128
130
134
108
440
122
442
118
120
444
116
102
B

100

132
126
128
134
130
108
550
122
552
118
120
110
116
102
104

SPARK PLUG WITH FIRING END HAVING DOWNWARD EXTENDING TINES

RELATED APPLICATIONS

The present application is a continuation-in-part of U.S. patent application Ser. No. 12/380,541, filed Mar. 2, 2009, titled "SPARK PLUG," which is a continuation-in-part of U.S. patent application Ser. No. 11/239,564, filed Sep. 28, 2005, now abandoned and titled "SPARK PLUG," which claims the benefit of U.S. Provisional Patent Application Ser. No. 60/613,221, filed Sep. 28, 2004, titled "SPARK PLUG;" the content of each is incorporated by reference herein in its entirety.

BACKGROUND OF THE INVENTION

1. Field of the Invention

The present invention relates generally to spark plugs for internal combustion engines, and more specifically to spark plugs including firing ends having downward extending tines.

2. Related Art

A spark plug is the ignition source in an internal combustion engine. One end of the spark plug extends into a cylinder head of the internal combustion engine, thereby exposing two electrodes in the cylinder head, with a gap between the two electrodes. A compressed mixture of fuel vapor and air in the cylinder is ignited by establishing an electrical discharge across the gap between the two electrodes at predetermined time intervals. Since the spark plug is an integral part of the proper and efficient operation of the internal combustion engine, there have been many efforts to improve the performance of the spark plug.

The spark plug creates an electrical arc in the cylinder head to ignite the air-fuel mixture. It may take up to 40,000 volts (supplied by an ignition coil connected to the center electrode) to create an arc that is sufficient to jump from the center electrode to ground in the pressurized environment of the combustion chamber. As spark plugs wear, the edges of traditional center electrodes round off, thereby increasing the voltage required to jump the gap (and thus resulting in the need to replace spark plugs periodically). As the voltage required to jump the gap increases, the chance of misfire fouling and/or pre-ignition increases, thereby resulting in rough idling, poor performance, reduced gas mileage, and increased emissions.

Traditionally, the structure of the spark plug has included a concentric arrangement of the following components: (1) a cylindrical, high-voltage center electrode; (2) an insulator (e.g., a ceramic insulator) surrounding the center electrode; and (3) a threaded shell surrounding the insulator. The threaded shell is configured for screwing into a tapped hole providing access to the interior of the cylinder of the internal combustion engine. Typically, the shell includes a metallic appendage acting as the ground electrode. These traditional spark plugs may be referred to as ground-wire tip spark plugs. The metallic appendage is fused to the rim of the shell, in close proximity to the center electrode. The purpose of this structure is to protect the center electrode from the corrosive environment of the cylinder, while simultaneously enabling the rapid dissipation of heat from the end of the center electrode to the cylinder head and to the insulator. The center electrodes of spark plugs may be fabricated utilizing nickel-chrome steel hollow sheaths surrounding copper alloy center members, for example.

Some of the efforts in improving the traditional spark plug (e.g., improving the performance, durability, efficiency, etc.) have focused on the materials used to fabricate the spark plug. For example, stronger, more durable materials (e.g. platinum, gold palladium, copper-core fine wire, etc.) have been used to fabricate the center electrode, thus resulting in a somewhat longer lifespan of the spark plug. Other efforts have focused on the design of the firing end of the center electrode. For example, tapered tip and split-tip spark plugs have been developed, although at significantly higher cost.

There is an ongoing need for improved spark plugs that provide, inter alia, one or more of the following characteristics: greater heat exchange from the center electrode through the insulator; a greater number of potential pathways for the spark to proceed, such that the spark may follow the path of least resistance; better flow of electricity from the terminal through the electrode; and/or greater turbulence in the vicinity of the spark to move more of the air-fuel mixture into the space adjacent the spark. Each of these characteristics contributes to a hotter spark and longer life of the spark plug, and thus a more efficient combustion process. In addition to the foregoing, there is a need for spark plugs that: reduce emissions; eliminate the need for indexing; eliminate fouling; and/or eliminate the need to adjust ground wires (e.g., eliminate the need to adjust the spark plug gap).

SUMMARY

To address the foregoing problems, in whole or in part, and/or other problems that may have been observed by persons skilled in the art, the present disclosure provides methods, apparatus, instruments, and/or devices, as described by way of example in implementations set forth below.

According to one implementation of the present invention, a spark plug includes a body and a center electrode extending through the body. The body includes a first end, a second end, an insulating portion, and a shell portion. The shell portion includes an exterior threaded section, a nut section positioned below the threaded section, and an electrically conductive, axially elongated firing ring positioned above the threaded section and terminating at an upper surface. The center electrode includes a terminal end extending beyond the first end of the body, and a firing end extending beyond the second end of the body. The terminal is configured for communicating with an ignition system of a vehicle. The firing end includes a plurality of tines. Each tine includes a first section extending radially from the firing end, and a second section extending axially toward the upper surface of the firing ring and terminating at a tip. The insulating portion electrically isolates the shell portion from the center electrode.

In some implementations, the tip of each tine is within a predetermined distance from the second end of the body.

In some implementations, each tine is within about 0.0001 inches from the upper surface of the firing ring.

In some implementations, the center electrode is made from an alloy including about 0.10 wt. % carbon, about 20.0 to about 23.0 wt. % chromium, about 5.00 wt. % iron, about 0.50 wt. % silicon, about 0.50 wt. % manganese, about 0.015 wt. % sulfur, about 0.015 wt. % phosphorous, about 8.00 to about 10.00 wt. % molybdenum, about 0.40 wt. % titanium, about 1.00 wt. % cobalt, about 3.15 to about 4.15 wt. % columbium and tantalum, about 0.40 wt. % aluminum, and nickel.

In some implementations, the insulating portion is made from a ceramic including about 2 to about 5 vol. % titanium alloy, wherein the titanium alloy includes about 90 wt. % titanium or greater, and wherein the ceramic has a grain size of about 1 to about 3 microns.

In some implementations, the firing ring includes a plurality of apertures therethrough, and the apertures are equally spaced about the perimeter of the firing ring.

In some implementations, each aperture has a radial dimension and an axial dimension, and the radial dimension of each aperture is greater than the axial dimension of each aperture.

In some implementations, the first section of each tine is substantially perpendicular to a central axis of the body.

In some implementations, the second section of each tine is substantially parallel with a central axis of the body.

In some implementations, each tine is equally spaced about the firing end.

According to another implementation of the present invention, the spark plug includes a body and a center electrode. The spark plug includes a first end, a firing ring opposite the first end, and a hollow interior defining a central axis. The center electrode extends through the hollow interior and includes a terminal end extending beyond and spaced apart from the firing ring. The terminal end includes at least one tine having a section extending axially toward the firing ring, substantially parallel to the central axis.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
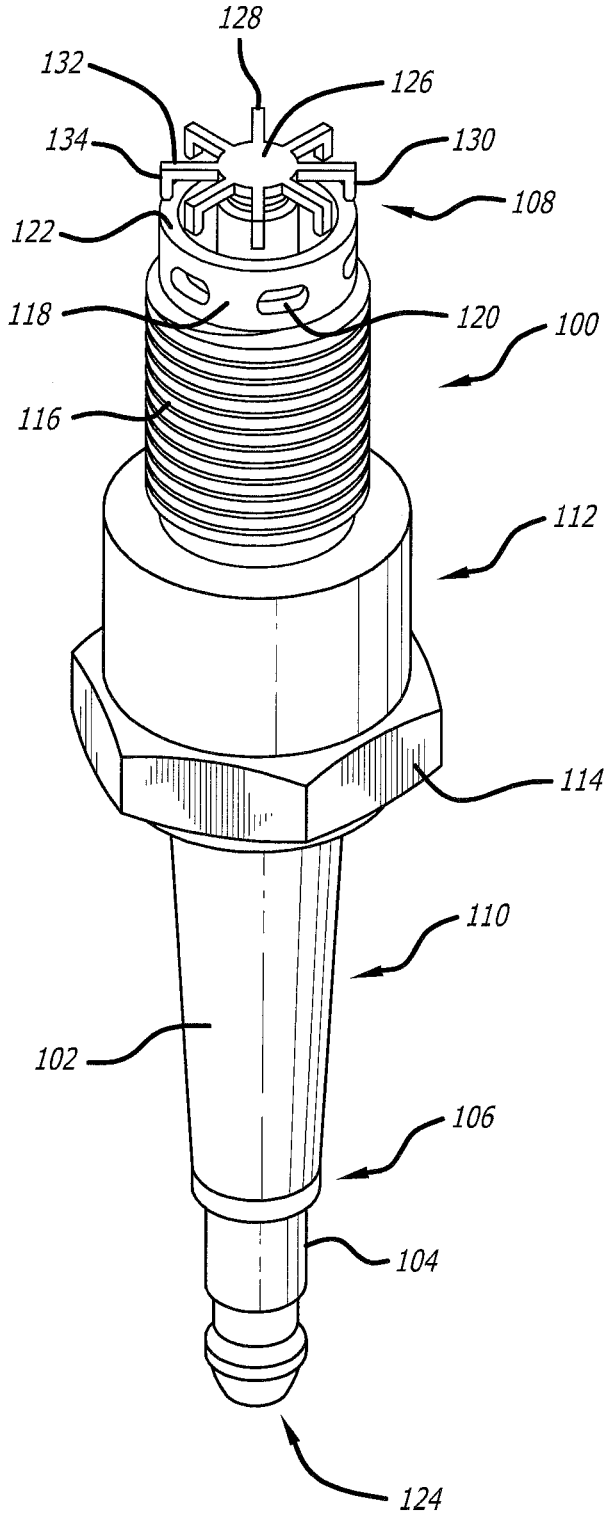
FIG. 1 is a perspective view of a spark plug according to one implementation of the present invention.

FIG. 1 is a perspective view of a spark plug 100 according to one implementation of the present invention. The spark plug 100 generally includes a body 102 and a center electrode 104 extending through the body 102. The body 102 may include a first end 106, a second end 108, an insulating portion 110, and a shell portion 112. The insulating portion 110 electrically isolates the shell portion 112 from the center electrode 104. In some implementations, the insulating portion 110 may include indentations and/or raised ridges along the outer surface of the insulating portion 110, so as to create heat sinks for rapid cooling of the spark plug 100. The insulating portion 110 may be made from any suitable insulating material known to those skilled in the art. In some implementations, the insulating portion 110 may be made from a ceramic including about 2 to about 5 vol. % titanium alloy. The titanium alloy may include about 90 wt. % titanium or greater, for example. In some implementations, the ceramic may have a grain size of about 1 to about 3 microns. In some implementations, the insulating material may include zirconia. The shell portion 112 of the body 102 may include a nut section 114, an exterior threaded section 116, and a firing ring 118. The nut section 114 may generally be configured in the form of a traditional nut, such that the spark plug 100 may be partially inserted in or removed from the cylinder head (not shown) of an internal combustion engine (not shown) by any suitable tool (such as a wrench). The exterior threaded section 116 may be configured for removable attachment to the engine block. As will be discussed below in more detail in conjunction with FIG. 2, the firing ring 118 may be positioned above the threaded section 116 and may be axially elongated (i.e., elongated in the direction of line A-A shown in FIG. 2) for increased surface area available for insertion into the cylinder head. The firing ring 118 may terminate at an upper surface 122. In some implementations, the firing ring 118 may be made of any suitable precious metal alloy. The firing ring 118 may provide the ground to which the spark from the center electrode 104 leaps. As further discussed below in conjunction with FIG. 4, the firing ring 118 may include a plurality of apertures 120 (or "holes") therethrough. The apertures 120 may be equally spaced (or substantially equally spaced) about the perimeter of the firing ring 118. The apertures 120 provide a means for gas to escape from the area in which the spark occurs; i.e., turbulent flow of the air-gas mixture (when the firing ring 118 is inserted into the cylinder head) increases in the area in which the spark occurs as a result of the apertures 120.

As further illustrated in FIG. 1, the center electrode 104 generally includes a terminal end 124 and a firing end 126. The terminal end 124 generally extends beyond the first end 106 of the body 102 and may be configured for communicating with an ignition system of a vehicle. The firing end 126 generally extends beyond the second end 108 of the body 102. As will be discussed in further detail below, the firing end 126 may include a plurality of tines 128. Each tine 128 may include a first section 132 (see the first section 132 shown in more detail in FIG. 5) extending radially outward (e.g., perpendicular to line A-A shown in FIG. 2) and a second section 134 extending axially downward (in the direction of line A-A shown in FIG. 2) toward the upper surface 122 of the firing ring 118 and terminating at a tip 130. The center electrode 104 may be constructed as a single piece. The center electrode may be made of any suitable material. In some implementations, the center electrode may be made from an Inconel 645 alloy including about 0.10 wt. % carbon, about 20.0 to about 23.0 wt. % chromium, about 5.00 wt. % iron, about 0.50 wt. % silicon, about 0.50 wt. % manganese, about 0.015 wt. % sulfur, about 0.015 wt. % phosphorous, about 8.00 to about 10.00 wt. % molybdenum, about 0.40 wt. % titanium, about 1.00 wt. % cobalt, about 3.15 to about 4.15 wt. % columbium and tantalum, about 0.40 wt. % aluminum, and nickel (e.g., the balance may be nickel). Various combinations of materials may be utilized in constructing the center electrode 104 in the light of the present disclosure.

Figure 2:
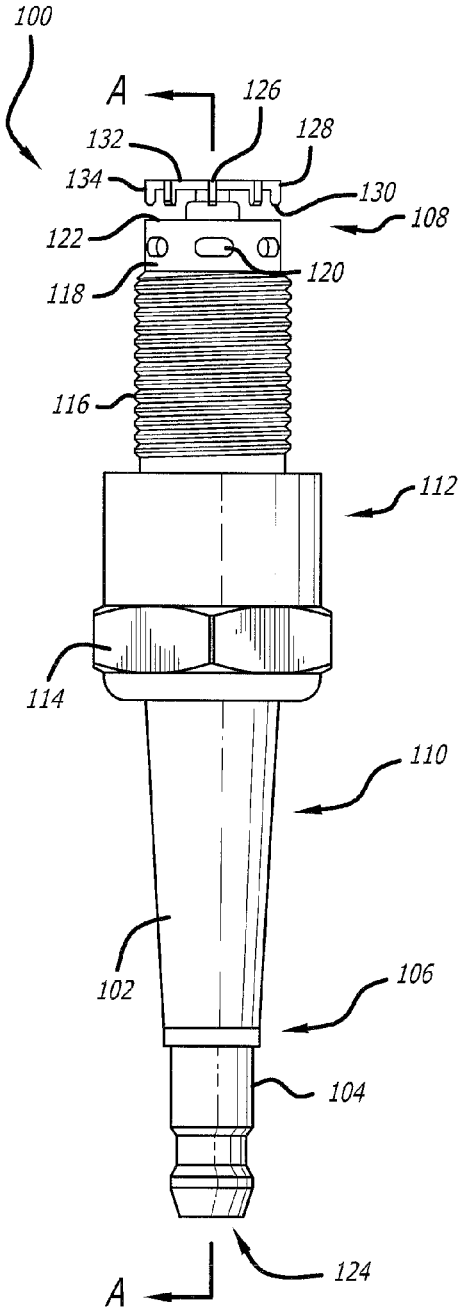
FIG. 2 is an elevation view of the spark plug illustrated in FIG. 1.
Figure 3:
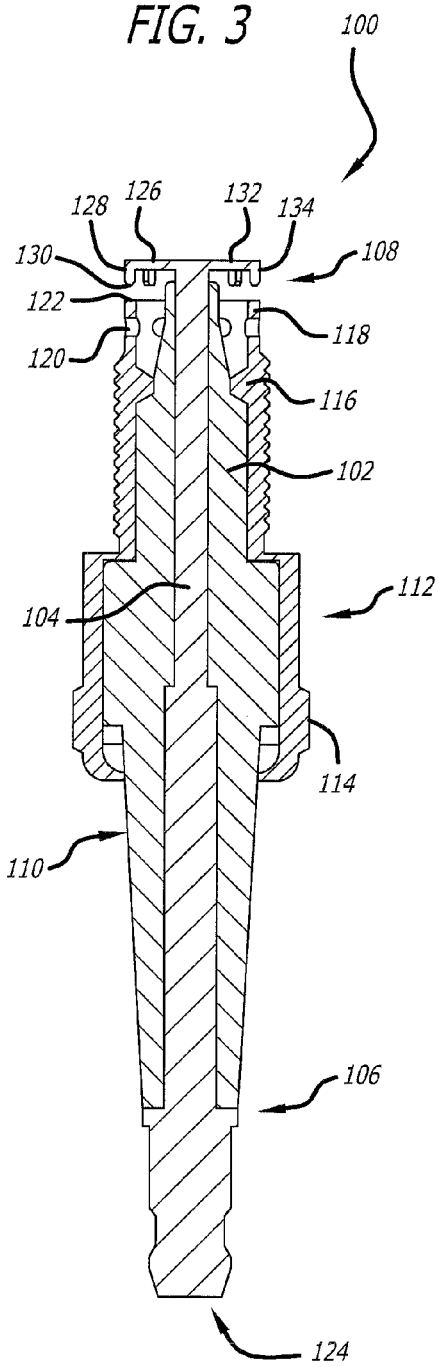
FIG. 3 is a cross-sectional elevation view of the spark plug illustrated in FIG. 2, taken across line A-A.

FIG. 2 is an elevation view of the spark plug 100 illustrated in FIG. 1. FIG. 3 is a cross-sectional elevation view of the spark plug 100 illustrated in FIGS. 1-2, taken across line A-A in FIG. 2, and showing the interior of the spark plug 100 in greater detail. Line A-A may be referred to herein as the central axis of the spark plug 100; or alternatively, the central axis of the body 102; or alternatively, the central axis of the center electrode 104. As shown in FIGS. 2-3, the firing ring 118 may be axially elongated (i.e., elongated in the direction of line A-A shown in FIG. 2) for increased surface area available for insertion into the cylinder head (which may result in higher torque, for example). In addition, the increased surface area present in the cylinder head may allow the spark plug 100 to cool faster as a result of increased contact with the cooled gas-air mixture present in the cylinder head.

Figure 4:
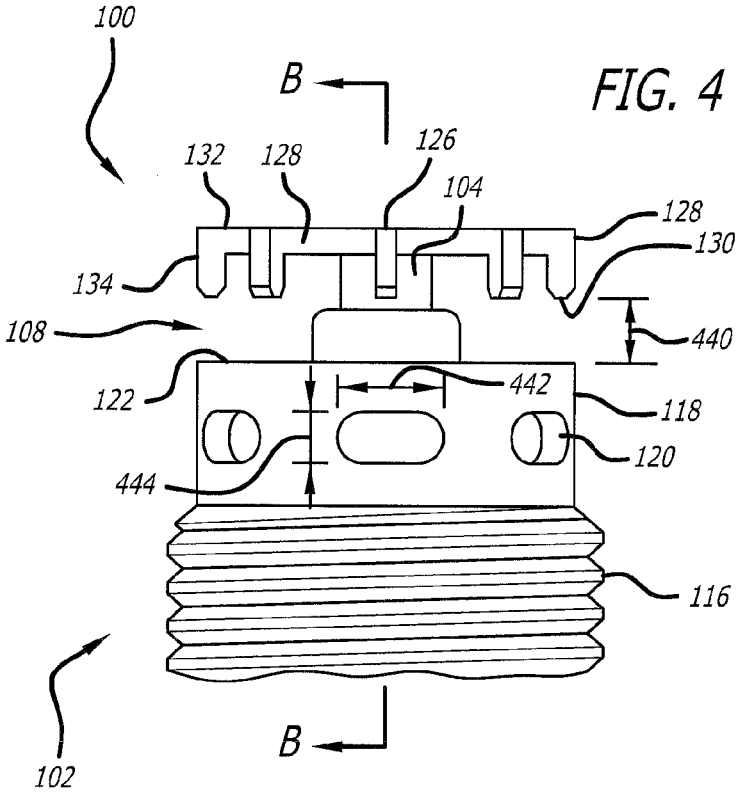
FIG. 4 is a cut-away view of a portion of the spark plug illustrated in FIG. 2.
Figure 5:
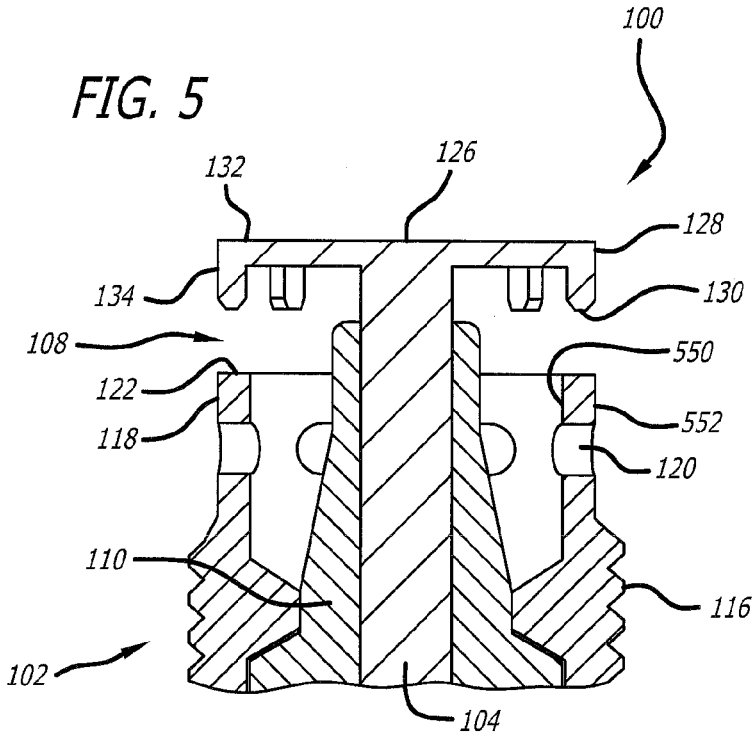
FIG. 5 is a cross-sectional elevation view of the portion of the spark plug illustrated in FIG. 4, taken across line B-B.

FIG. 4 is a cut-away view of a portion of the spark plug 100 illustrated in FIG. 2. Dimensions of apertures. FIG. 5 is a cross-sectional elevation view of the portion of the spark plug illustrated in FIG. 4, taken across line B-B, and showing the interior of the spark plug 100 in greater detail. Line B-B may be referred to herein as the central axis of the portion of the spark plug 100 illustrated in FIGS. 3-4; or alternatively, the central axis of the portion of the body 102 illustrated in FIGS. 3-4; or alternatively, the central axis of the portion of the center electrode 104 illustrated in FIGS. 3-4. As shown FIG. 4, the tip 130 of each tine 128 may be within a predetermined distance 440 of the upper surface 122 of the firing ring 118. In some implementations, the predetermined distance 440 may be less than about 0.0001 inches. The predetermined distance 440 may be optimized for the individual user. The predetermined distance 440 is an important characteristic of the spark plug 100 because the electrical arc creating the spark may travel the predetermined distance between the upper surface 122 of the firing ring 118 and the tip 130 of one or more tines 128.

As discussed above, the firing ring 118 may include a plurality of apertures 120 therethrough. As illustrated in FIG. 4, each aperture may include a radial dimension 442 and an axial dimension 444. In some implementations, the radial dimension 442 may be greater than the axial dimension 444. Alternatively, in some implementations, the radial dimension 442 may be less than the axial dimension 444.

As further illustrated in FIG. 4, the first section 132 of each tine 128 may be substantially perpendicular to the central axis B-B of the body 102. The second section 134 of each tine 128 may be substantially parallel with the central axis B-B of the body. Each tine 128 may be equally (or substantially equally) spaced about the firing end 126 of the center electrode 104. As illustrated in FIG. 5, the firing ring 118 may include an inner wall 550 and an outer wall 552. In some implementations, the first section 132 of each tine 128 may extend out radially to, at most the outer wall 552.

Figure 6:
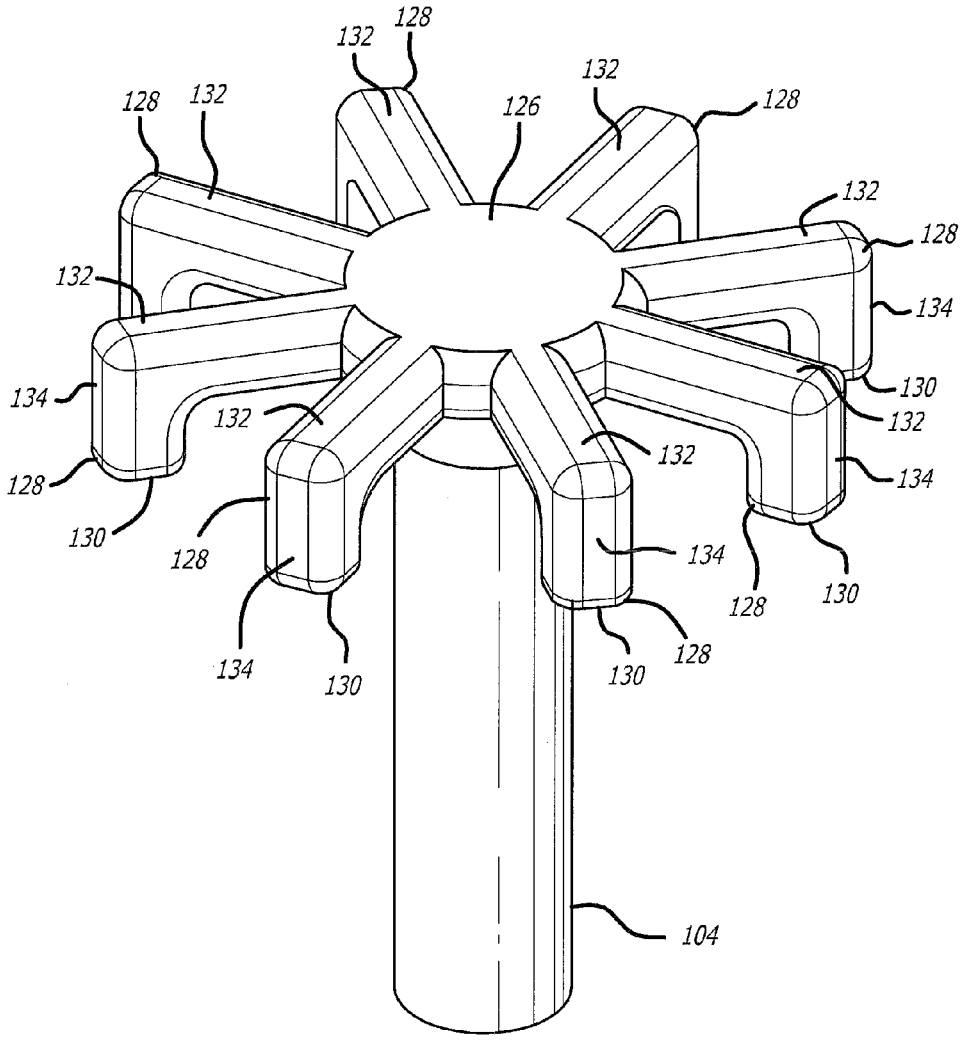
FIG. 6 is a perspective view of a portion of a center electrode of the spark plug illustrated in FIGS. 1-5.

FIG. 6 is a perspective view of a portion of the center electrode 104 illustrated in FIGS. 1-5, and showing in greater detail the firing end 126. As shown in FIG. 6, in some implementations the tines 128 may be contoured. While the firing end 126 illustrated in FIG. 6 shows eight, equally spaced tines 128 about the firing end 126, it will be understood that any suitable number of tines 128 may be utilized in conjunction with the spark plug 100 of the present disclosure. The plurality of downward extending tines 128 allows the spark created by the spark plug 100 to follow the path of least resistance in the cylinder head. For example, if a tip 130 becomes impaired (by corrosion, for example), the spark may follow a path that does not include the impaired tip. This feature may greatly extend the life of the spark plug 100. Since the tips 130 of the tines 128 extend downward toward the firing ring 118, and are parallel with the center axis (line A-A in FIG. 2 or line B-B in FIG. 4), sparking occurs against the body 102 itself, as opposed to sparking against the walls of the valves or pistons present in the engine of the vehicle in which the spark plug 100 is installed. This results in more efficient contact for sparking purposes.

Spark plugs of the present invention are configured such that the contact points (i.e., the tip 130 of each tine 128) of the center electrode 104 are turned down towards and fire against the plug body itself (i.e., the firing ring 118). This configuration has several advantages over the spark plug constructions presently existing in the art: (1) spark plug of the present invention makes a better electrical contact with the ground, (2) there is no ground wire (or electrode) to impede the propagation of the electrode flame front, and (3) there is no ground wire (or electrode) to impede the path of gasoline passing through the electrode gap (i.e., the gap between the electrode and the ground). In addition, race car drivers using standard spark plugs do what persons in the art call "indexing, where the driver aims the back of the L-shaped ground wire towards the exhaust valve. Generally speaking, the idea of indexing is to position the spark plug so that the electrode is facing the center of the cylinder, angled slightly toward the exhaust valve—the most common arrangement. This is important because, as the piston approaches top-dead-center (TDC), the air/fuel charge is being compressed. Thus, the charge or fuel mixture is being forced toward the area of the spark plug and, normally, the exhaust valve. The true speed of this force inside the combustion chamber is extremely fast (some experts speculate that it surpasses supersonic speeds). Because of this, the spark generated from the plug should be in a "position" to create the best possible flame front. Using standard spark plugs, the L-shaped electrode may actually block the flame process. On the other hand, if the electrode gap faces the on-rushing air/fuel charge, it stands a much better chance of igniting a flame front. The tines 128 of the present invention do not impede the flame front or obstruct the fluid path of gasoline passing through the electrode gap, therefore the practice of indexing is not necessary because spark plugs of the present invention will achieve optimum performance regardless of where they are positioned in the combustion chamber.

Further, spark plugs of the present invention do not foul. Spark plug fouling may prevent an engine from starting and/or increase cranking during starting. Generally speaking, a spark plug is considered fouled when the insulator nose at the firing tip becomes coated with a foreign substance such as fuel, oil or carbon. This coating causes the voltage to follow along the insulator nose, leach back down into the metal shell, and short the center wire to ground rather than bridging the gap and firing normally. Thus, impedance across the electrode gap is a measure of the accumulation of deposits, or fouling. Fuel, oil, ash and carbon fouling can all be the result of different causes but, once a spark plug is fouled, it will not provide adequate voltage to the firing tip and that cylinder will not fire properly. In many cases, the spark plug cannot be cleaned sufficiently to restore normal operation. Therefore, it is recommended that a plug be replaced once it is fouled.

However, the construction of spark plugs of the present invention prevents fouling because the center electrode 104 is sufficiently insulated from the ground (i.e., the firing ring 118), such that any deposit accumulation on the center electrode 104 would not provide a secondary path for electrical communication between the center electrode 104 and the ground.

Moreover, the center electrode 104 according to the present teaching may be a unitary member and the increased surface area of the firing end 126 results in a higher torque over conventional spark plugs. Due to the fact there is more metal (surface area) in the combustion chamber more torque is created. Further, as discussed above, the insulating portion 110 allows the spark plug 100 to cool faster, as a cooler spark plug runs more efficiently. Most spark plugs rely on the ceramic itself and the water jacket surrounding the spark plug for cooling. Spark plugs of the present invention may be cooled immediately by the cool gas entering the combustion chamber from the fuel tank, thereby allowing the gas to expand quicker and, in return, generate more horsepower. Thus, spark plugs of the present invention may require less gas over existing sparkplugs to produce the same amount of horsepower and torque.

Spark plugs according the present teaching have been made and tested for performance. Such tests have revealed increased engine performance, showing that, on average, spark plugs of the present invention may result in an increased engine fuel efficiency of about 10%-12%, a reduction in hydrocarbons by about 50% or more, a reduction in nitrogen oxide output of approximately 600% during idling, an increase in horsepower by as much as about 6%, and an increase in torque by as much as about 4%, over existing spark plugs.

EXAMPLE 1

Figure 7:
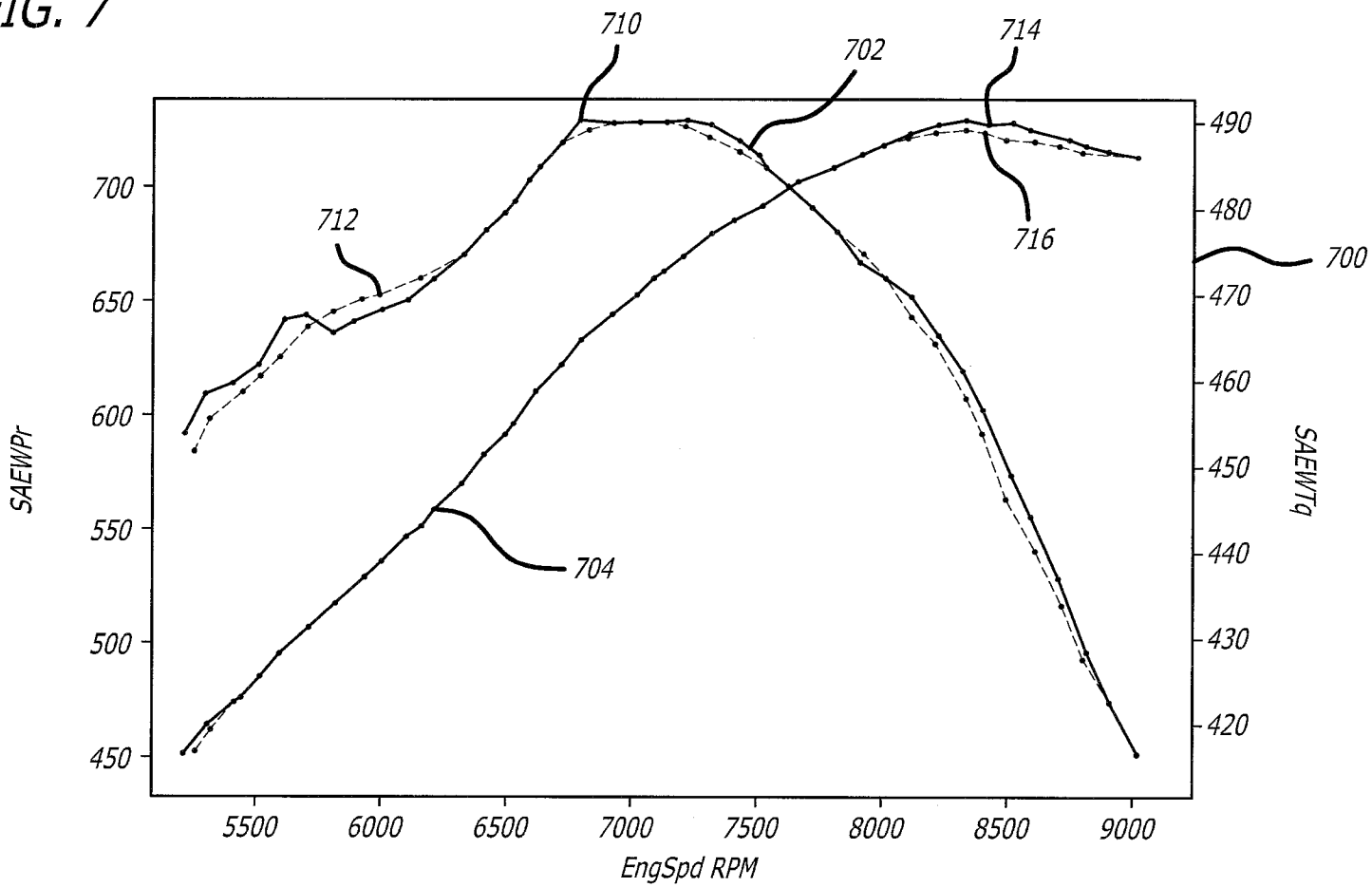
FIG. 7 is a graphical representation of an example plot comparing the performance of a spark plug according to the teachings of the present invention to the performance of a competing spark plug in a high performance sportscar.

For example, a spark plug according to one implementation of the present invention was tested on a high performance NASCAR Dodge race engine and compared against an Autolite 3910X model spark plug, between the engine speeds of about 7000 RPM and about 8900 RPM. FIG. 7 is a graphical representation of a plot 700 illustrating the performance of the spark plug of the present invention 710, 712 over the performance of the Autolite spark plug 714, 716. The tests were conducted under two different operating conditions 702 and 704. FIG. 7 shows about a 3.2% increase in horsepower and about a 1.2 ft-lbs increase in torque.

EXAMPLE 2

Figure 8:
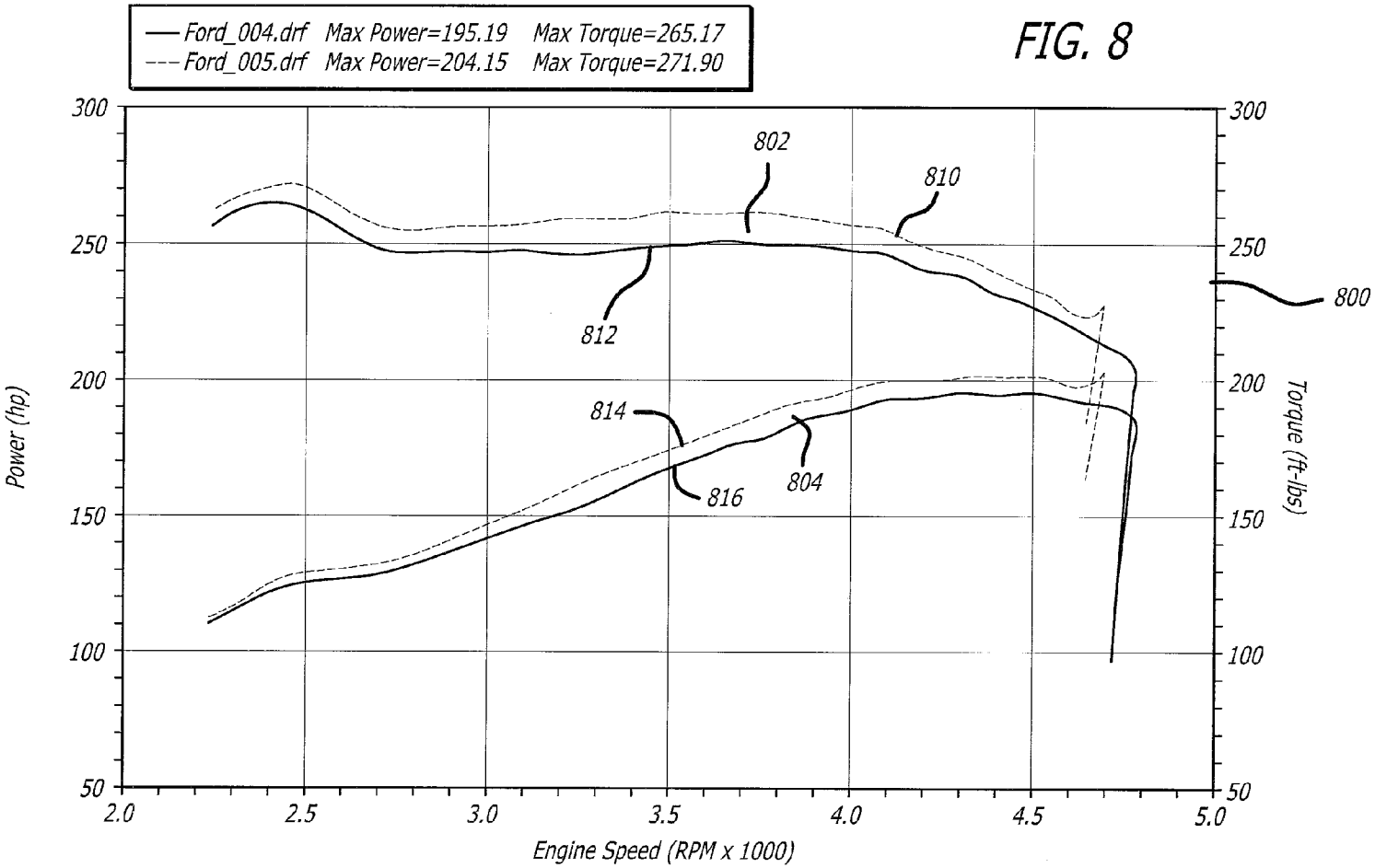
FIG. 8 is a graphical representation of another plot comparing the performance of a spark plug according to the teachings of the present invention to the performance of a competing spark plug in a truck.

In a second example, a spark plug according to one implementation of the present invention was tested on a Ford Special Edition Harley Davidson truck. The spark plug was tested against a Champion RS12YC model spark plug, between the engine speeds of about 2000 RPM and about 5000 RPM. FIG. 8 is a graphical representation of a plot 800 illustrating the performance of the spark plug of the present invention 810, 812 over the performance of the Champion spark plug 814, 816. The tests were conducted under two different operating conditions 802 and 804. The first test 802 was conducted at an ambient temperature of about 73° F. and a humidity of about 33%. The second test 804 was conducted at an ambient temperature of about 75° F. and a humidity of about 28%. FIG. 8 shows that the spark plug of the present invention resulted in about a 4.2% increase in horsepower and about a 2.5 ft-lbs increase in torque.

EXAMPLE 3

In a third example, a spark plug according to one implementation of the present invention was tested on a 124 cubic inch Evolution style 2 cylinder motorcycle engine. The spark plug was tested against an NGK DCPR7E style spark plug. Based on these tests, the spark plug of the present invention resulted in about a 3.6% increase in horsepower and about a 4.9% increase in ft-lbs torque.

EXAMPLE 4

In a fourth example, a spark plug according to one implementation of the present invention was tested on a 1999 Chevy Corvette V-8 cylinder engine. The spark plug was tested against a Champion RS14YC6 model spark plug, between the engine speeds of about 2000 RPM and about 6500 RPM. Table I describes the test results of Champion spark plug tested at an absolute barometric pressure of 29.92 in. Hg., vapor pressure of 0.52 in. Hg., and an intake air temperature of 79.8° F.

TABLE I

| | --Measured-- | | --Corrected-- | | |
|---|---|---|---|---|---|
| Engine RPM | T ft-lb | P hp | T ft-lb | P hp | Time (sec) |
| 2000 | 121.1 | 46.1 | 120.7 | 46.0 | 0.00 |
| 2250 | 312.5 | 133.9 | 311.4 | 133.4 | 0.84 |
| 2500 | 316.0 | 150.5 | 314.9 | 149.9 | 1.54 |
| 2750 | 325.9 | 170.7 | 324.8 | 170.1 | 2.21 |
| 3000 | 332.4 | 189.9 | 331.3 | 189.2 | 2.87 |
| 3250 | 334.8 | 207.2 | 333.6 | 206.5 | 3.52 |
| 3500 | 340.4 | 226.9 | 339.3 | 226.1 | 4.17 |
| 3750 | 348.9 | 249.1 | 347.7 | 248.2 | 4.80 |
| 4000 | 355.9 | 271.0 | 354.7 | 270.1 | 5.42 |
| 4250 | 355.8 | 287.9 | 354.6 | 286.9 | 6.03 |
| 4500 | 360.1 | 308.6 | 358.9 | 307.5 | 6.64 |
| 4750 | 361.3 | 326.7 | 360.0 | 325.6 | 7.24 |
| 5000 | 357.9 | 340.8 | 356.7 | 336.4 | 7.85 |
| 5250 | 352.1 | 352.0 | 350.9 | 350.8 | 8.64 |
| 5500 | 343.3 | 359.5 | 342.2 | 358.3 | 9.10 |
| 5750 | 330.1 | 361.4 | 329.0 | 360.2 | 9.75 |
| 6000 | 317.6 | 362.6 | 316.4 | 361.4 | 10.43 |
| 6250 | 305.9 | 364.0 | 304.8 | 362.8 | 11.13 |
| 6500 | 290.7 | 359.8 | 289.7 | 358.6 | 11.87 |
| Avg: | 324.3 | 266.8 | 323.3 | 265.9 | |
| Max: | 361.3 | 364.0 | 360.0 | 362.8 | |

Table II describes the test results of one implementation of a spark plug according to the present invention tested at an absolute barometric pressure of 29.92 in. Hg., vapor pressure of 0.52 in. Hg., and an intake air temperature of 75.7° F.

TABLE II

| | --Measured-- | | --Corrected-- | | |
|---|---|---|---|---|---|
| Engine RPM | T ft-lb | P hp | T ft-lb | P hp | Time (sec) |
| 2250 | 309.50 | 132.6 | 307.1 | 131.6 | 0.00 |
| 2500 | 321.4 | 153.0 | 318.9 | 151.8 | 0.69 |
| 2750 | 329.3 | 172.4 | 326.7 | 171.1 | 1.35 |
| 3000 | 334.6 | 191.1 | 332.0 | 189.6 | 2.01 |
| 3250 | 340.7 | 210.8 | 338.1 | 209.2 | 2.65 |
| 3750 | 353.2 | 252.2 | 350.4 | 250.2 | 3.91 |
| 4000 | 359.0 | 273.4 | 356.2 | 271.3 | 4.52 |
| 4250 | 356.5 | 288.5 | 353.7 | 286.2 | 5.13 |
| 4500 | 361.6 | 309.8 | 358.8 | 307.4 | 5.74 |
| 4750 | 362.4 | 327.8 | 359.5 | 325.2 | 6.34 |
| 5000 | 360.2 | 343.0 | 357.4 | 340.3 | 6.94 |
| 5250 | 352.7 | 352.6 | 349.9 | 349.8 | 7.56 |
| 5500 | 344.3 | 360.6 | 341.6 | 357.8 | 8.19 |
| 5750 | 331.3 | 362.7 | 328.7 | 359.9 | 8.84 |
| 6000 | 318.1 | 363.4 | 315.6 | 360.6 | 9.52 |
| 6250 | 304.8 | 362.8 | 302.4 | 359.9 | 10.23 |
| 6500 | 290.3 | 359.3 | 288.0 | 356.5 | 10.97 |
| Avg: | 337.6 | 280.4 | 334.9 | 278.2 | |
| Max: | 362.4 | 363.4 | 359.5 | 360.6 | |

The test results of Tables I and II show that the spark plug of the present invention yielded a 4.i % increase in ft-lbs torque and a 5.1% increase in horsepower over the Champion RS14YC6 model spark plug.

The spark plug 100 described herein may be utilized in conjunction with internal combustion engines to reduce emissions and make the combustion process more efficient. With the center electrode 104 extending further into the cylinder head, more of the surface area of the spark plug 100 is in contact with the air-gas mixture within the cylinder head. The spark plug 100 described herein eliminates the need for a conventional grounding wire, thus eliminating the need for adjustment of such traditional grounding wires. In addition, there is no traditional grounding wire to impede the flow of the gas-air mixture in the vicinity of the firing ring 118 for sparking.

In general, terms such as "coupled to," and "configured for coupling to" and "secured to" and "in engagement with" and "in communication with" (for example, a first component is "coupled to" or "is configured for coupling to" or is "secured to" or is "in engagement with" or is "in communication with" a second component) are used herein to indicate a structural, functional, mechanical, electrical, signal, optical, magnetic, electromagnetic, ionic or fluidic relationship between two or more components or elements. As such, the fact that one component is said to couple to a second component is not intended to exclude the possibility that additional components may be present between, and/or operatively associated or engaged with, the first and second components.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A spark plug, comprising:

a body comprising a first end, a second end, an insulating portion and a shell portion, wherein the shell portion comprises an exterior threaded section, a nut section positioned below the threaded section, and an electrically conductive tubular firing ring positioned above and axially extending a predetermined distance from the threaded section, the firing ring including at least one aperture formed therethrough and terminating at an upper surface; and a center electrode having a tubular portion extending through the body and comprising a terminal end extending beyond the first end of the body, the terminal end being configured for communicating with an ignition system of a vehicle, and a firing end extending beyond the second end of the body, the firing end comprising a plurality of elongated and substantially rectangular tines, each tine comprising a first section extending radially from the firing end and a second section substantially perpendicular to the first section and extending axially and substantially parallel with a central axis of the body toward the upper surface of the firing ring and terminating at a tip, wherein the insulating portion electrically isolates the shell portion from the center electrode, the insulating portion extending upward axially above the threaded section and about the center electrode to a height spaced apart from the first section and substantially corresponding to the tip, and wherein the tubular portion and the plurality of tines are integrally formed from a unitary piece of material.

2. The spark plug of claim 1, wherein the tip of each tine is within a predetermined distance from the upper surface of the firing ring.

3. The spark plug of claim 2, wherein the predetermined distance is less than about 0. 0001 inches.

4. The spark plug of claim 1, wherein the center electrode is made from an alloy including about 0.10 wt. % carbon, about 20.0 to about 23.0 wt. % chromium, about 5.00 wt. % iron, about 0.50 wt. % silicon, about 0.50 wt. % manganese, about 0.015 wt. % sulfur, about 0.015 wt. % phosphorous, about 8.00 to about 10.00 wt. % molybdenum, about 0.40 wt. % titanium, about 1.00 wt. % cobalt, about 3.15 to about 4.15 wt. % columbium and tantalum, about 0.40 wt. % aluminum, and nickel.

5. The spark plug of claim 1, wherein the insulating portion is made from a ceramic including about 2 to about 5 vol. % titanium alloy, wherein the titanium alloy includes about 90wt. % titanium or greater, and wherein the ceramic has a grain size of about 1 to about 3 microns.

6. The spark plug of claim 1, wherein the firing ring includes a plurality of apertures therethrough, and the apertures are substantially equally spaced about the perimeter of the firing ring.

7. The spark plug of claim 6, wherein each aperture includes a radial dimension and an axial dimension, and the radial dimension of each aperture is greater than the axial dimension of each aperture.

8. The spark plug of claim 1, wherein the first section of each tine is substantially perpendicular to a central axis of the body.

9. The spark plug of claim 1, wherein each tine is substantially equally spaced about the firing end.

10. A spark plug of claim 1, wherein the firing ring comprises an inner wall and an outer wall, and the first section of each tine extends out to, at most, the outer wall.

11. A center electrode for a spark plug, comprising:

a tubular body, the tubular body extending between a terminal end configured for communicating with an ignition system of a vehicle; and a firing end comprising a plurality of elongated and substantially rectangular tines, wherein each tine comprises a first section extending radially outward from the firing end and a second section substantially perpendicular to the first section and extending axially downward and substantially parallel with a central axis of the center electrode from the firing end and terminating at a tip, and wherein tubular body and the plurality of tines are integrally formed from a unitary piece of material.

12. The center electrode of claim 11, wherein a top surface of each tine is substantially coplanar with a top surface of the firing end.

13. The center electrode of claim 11, wherein the center electrode is made from an alloy including about 0.10 wt. % carbon, about 20.0 to about 23.0 wt. % chromium, about 5.00wt. % iron, about 0.50 wt. % silicon, about 0.50 wt. % manganese, about 0.015 wt. % sulfur, about 0.015 wt. % phosphorous, about 8.00 to about 10.00 wt. % molybdenum, about 0.40 wt. % titanium, about 1.00 wt. % cobalt, about 3.15 to about 4.15 wt. % columbium and tantalum, about 0.40 wt. % aluminum, and nickel.

14. The center electrode of claim 11, wherein the first section of each tine is substantially perpendicular to a central axis of the center electrode.

15. The center electrode of claim 11, wherein each tine is substantially equally spaced about the firing end.

16. A spark plug, comprising:

a body comprising a first end, a tubular firing ring opposite the first end, a hollow interior defining a central axis, and an electrical insulator, wherein the firing ring includes at least one aperture formed the therethrough; and a center electrode having a tubular portion extending through the hollow interior and comprising a terminal end extending beyond and spaced apart from the firing ring, the terminal end comprising a plurality of elongated and substantially rectangular tines having a section extending axially toward the firing ring, substantially parallel to the central axis, wherein the electrical insulator extends from the first end to a height corresponding to a terminating end of the section extending axially toward the firing ring, and wherein the tubular portion and the plurality of tines are integrally formed from a unitary piece of material.

17. The spark plug of claim 16, wherein each tine is electrically insulated from the firing ring.

18. The spark plug of claim 16, wherein each tine comprises a first section extending radially from the center electrode substantially perpendicular to the central axis, and a second section extending axially toward the upper surface of the firing ring parallel to the central axis and terminating at a tip spaced apart from the firing ring.

* * * * *